United States Patent [19]

Watkins

[11] 4,425,368

[45] Jan. 10, 1984

[54] FOOD HEATING CONTAINER

[75] Inventor: James D. Watkins, Minneapolis, Minn.

[73] Assignee: Golden Valley Foods Inc., Prairie, Minn.

[21] Appl. No.: 311,916

[22] Filed: Oct. 16, 1981

Related U.S. Application Data

[63] Continuation-in-part of Ser. No. 283,145, Jul. 13, 1981, which is a continuation of Ser. No. 33,972, Apr. 27, 1979, abandoned.

[51] Int. Cl.[3] ..... B65D 81/34

[52] U.S. Cl. ..... 426/107; 426/113; 426/118; 426/124; 426/234; 219/10.55 E; 219/10.55 M; 206/491; 206/525; 229/DIG. 14; 220/367

[58] Field of Search ..... 426/107, 113, 234, 241, 426/242, 243, 393, 524, 124, 118; 99/451, 447, 428; 219/10.55 E, 10.55 M, 10.55 R

[56] References Cited

U.S. PATENT DOCUMENTS

| | | | |
|---|---|---|---|
| 1,099,603 | 6/1914 | Ingersoll | 426/113 |
| 1,476,910 | 12/1923 | Naugle . | |
| 1,906,592 | 5/1933 | Hiester . | |
| 2,039,374 | 5/1936 | Young | 426/113 |
| 2,271,921 | 2/1942 | Luker | 426/128 |
| 2,290,396 | 7/1942 | Webster . | |
| 2,540,036 | 1/1951 | Spencer | 426/243 |
| 2,559,101 | 7/1951 | Wool . | |
| 2,576,862 | 11/1951 | Smith et al. | 426/234 |
| 2,591,578 | 4/1952 | McNealy et al. | 426/124 |
| 2,600,566 | 6/1952 | Moffett | 426/234 |
| 2,660,529 | 11/1953 | Bloom . | |
| 2,714,070 | 7/1955 | Welch | 426/234 |
| 2,960,218 | 11/1960 | Cheeley | 426/113 |
| 2,961,520 | 11/1960 | Long | 219/10.55 E |
| 3,141,400 | 7/1964 | Powers | 426/113 |
| 3,179,036 | 4/1965 | Luker | 99/428 |
| 3,191,520 | 6/1965 | Halter | 99/442 |
| 3,219,460 | 11/1965 | Brown | 426/107 |
| 3,220,856 | 11/1965 | Vischer | 426/113 |
| 3,240,610 | 3/1966 | Cease | 426/113 |
| 3,246,446 | 4/1966 | Powers | 426/128 |
| 3,262,668 | 7/1966 | Luker | 99/428 |
| 3,271,169 | 9/1966 | Baker et al. | 426/107 |
| 3,445,050 | 5/1969 | Peters et al. | 426/120 |
| 3,547,661 | 12/1970 | Stevenson | 426/107 |
| 3,610,135 | 10/1971 | Sheridan | 99/430 |
| 3,865,301 | 2/1975 | Pothier et al. | 426/107 |
| 3,881,027 | 4/1975 | Levinson | 219/10.55 E |
| 3,884,213 | 5/1975 | Smith | 99/473 |
| 3,884,383 | 5/1975 | Burch et al. | 150/0.5 |
| 3,941,967 | 3/1976 | Sumi et al. | 219/10.55 E |
| 3,965,323 | 6/1976 | Forker et al. | 219/10.55 E |
| 3,974,353 | 3/1976 | Goltsos | 219/10.55 E |
| 3,975,552 | 8/1976 | Stanbroom | 426/243 |
| 3,983,256 | 9/1976 | Norris et al. | 426/128 |
| 3,985,990 | 10/1976 | Levinson | 219/10.55 E |
| 4,031,261 | 6/1977 | Durst | 426/144 |
| 4,096,948 | 6/1978 | Kuchenbecker | 426/122 |
| 4,133,896 | 1/1979 | Standing et al. | 426/107 |
| 4,154,860 | 5/1979 | Daswick | 426/113 |
| 4,228,945 | 10/1980 | Wysocki | 426/122 |
| 4,351,997 | 9/1982 | Mattisson et al. | 426/107 |

OTHER PUBLICATIONS

NUPAC Publication, Tacoma, Wash., "Fluted Tube Pan".

*Primary Examiner*—Steven L. Weinstein
*Attorney, Agent, or Firm*—James V. Harmon

[57] ABSTRACT

According to the present invention, the package including a centrally-cored, dish-like container of food having a cover sealed across its mouth is provided in a carton, e.g. made of paper, which encloses a larger space than that occupied by the container of food. The cover of the container of food has regions which may be easily fork-pierced and the carton has apertures overlying these fork-pierceable regions of the container cover. Accordingly, the food may be warmed from a chilled or frozen state by fork-piercing the container cover through the carton apertures for permitting the escape of steam that will be generated in the food during the heating process, and then placing the package, still in its carton, in the microwave oven. As heating proceeds, steam escapes from the food through the pierced holes in the cover and then from the carton through the apertures which overlie the pierced holes. For further permitting the escape of steam from the carton, one or more additional vent openings, not aligned with fork-pierceable regions in the container cover are provided through the carton wall. The bottom of the carton, at a site in line with the container core, may be provided with a further opening through which the person who is warming the food may insert a finger for manually testing whether the food seems to be sufficiently heated.

9 Claims, 24 Drawing Figures

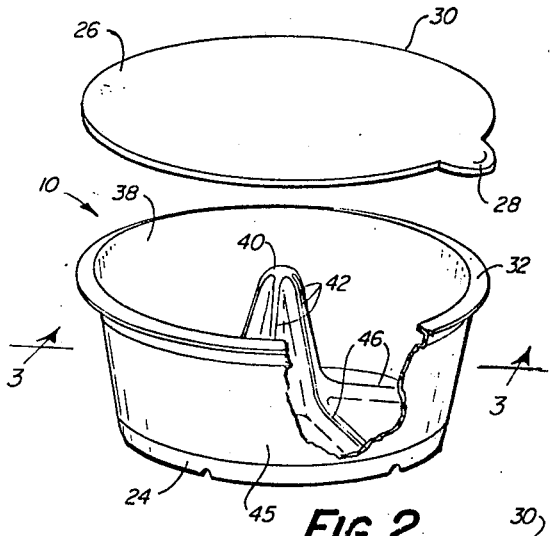

FIG. 2

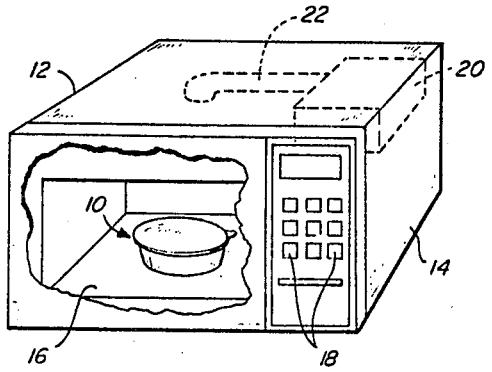

FIG. 1

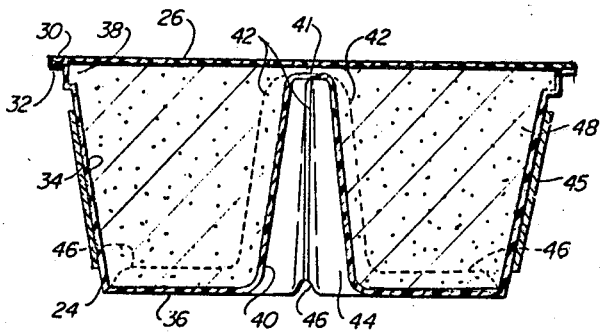

FIG. 3

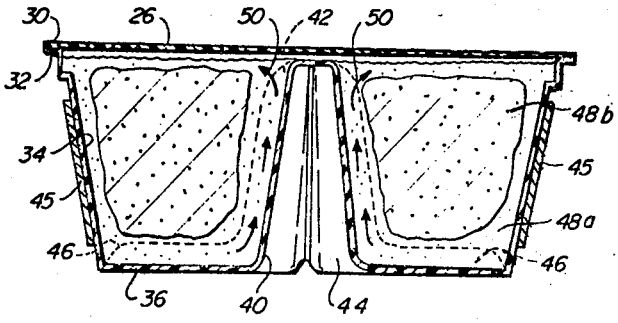

FIG. 4

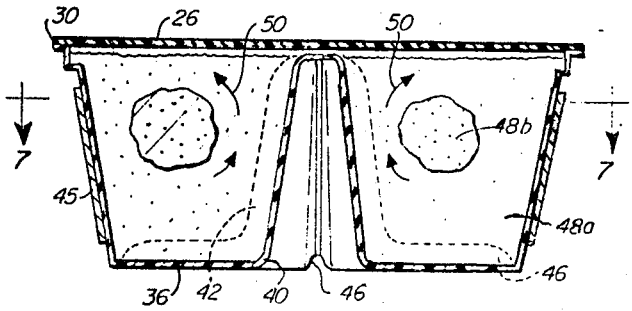

FIG. 5

PROVIDE A DISPOSABLE SHIPPING CONTAINER INCLUDING A LOW LOSS FOOD MOLDING CORE THAT IS TRANSPARENT TO MICROWAVE ENERGY

FILL THE CONTAINER WITH A FOOD PRODUCT AND MAINTAIN THE INTERIOR OF THE CORE FREE FROM THE FOOD

EACH CORE MOULDING A TUBULAR MICROWAVE INFLUX PASSAGE WITHIN THE FOOD

CHILLING THE CONTAINER AND THE FOOD THEREIN TO SOLIDIFY THE FOOD TO PREDETERMINED SHAPE WITH THE TUBULAR PASSAGE THROUGH THE FOOD AROUND EACH CORE

DISTRIBUTING THE FOOD WITHIN THE CONTAINER WHEREBY DURING SUBSEQUENT MICROWAVE HEATING, MICROWAVE ENERGY WILL READILY PASS THROUGH THE CORE AND HEAT THE FOOD AROUND THE CORE

FIG. 16

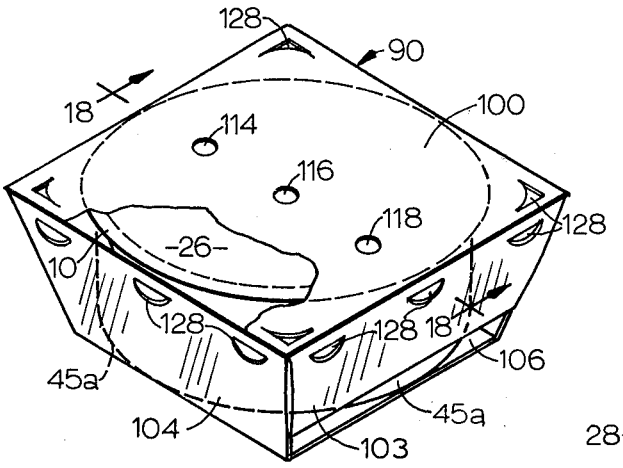
FIG. 17
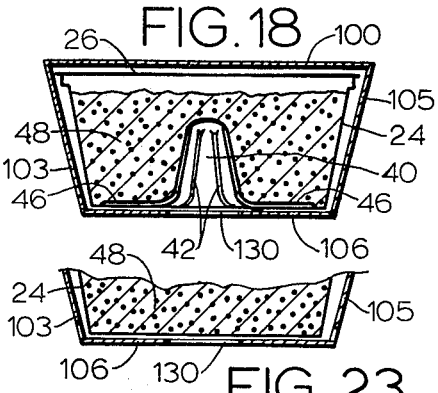
FIG. 18
FIG. 23
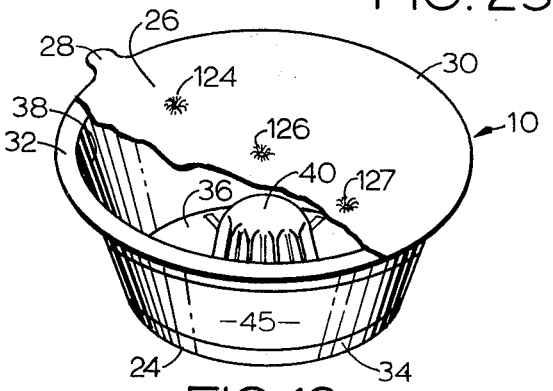
FIG. 19
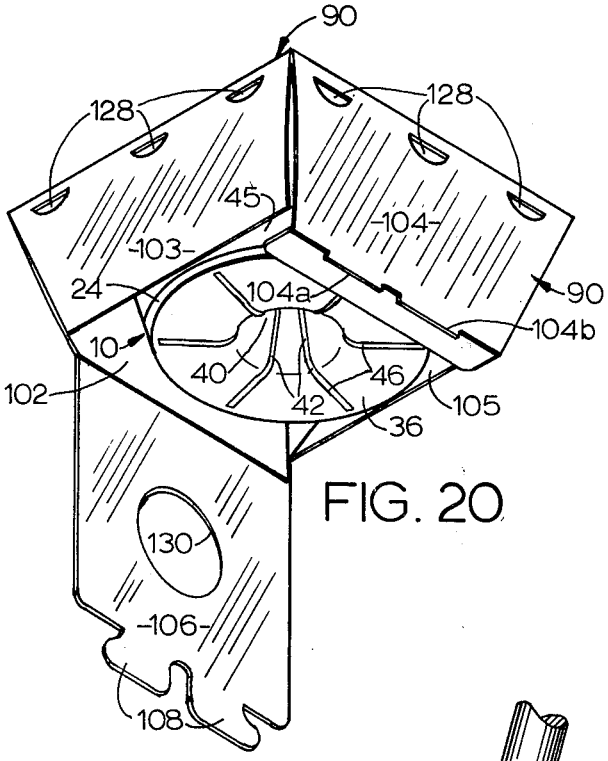
FIG. 20
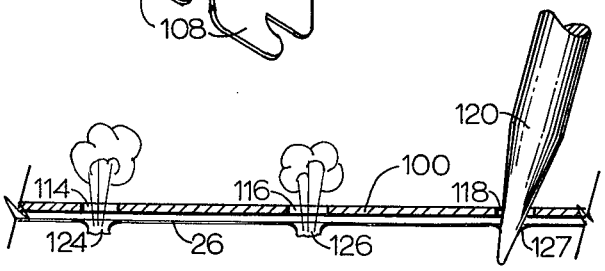
FIG. 22
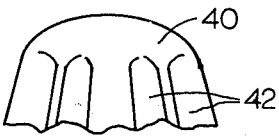
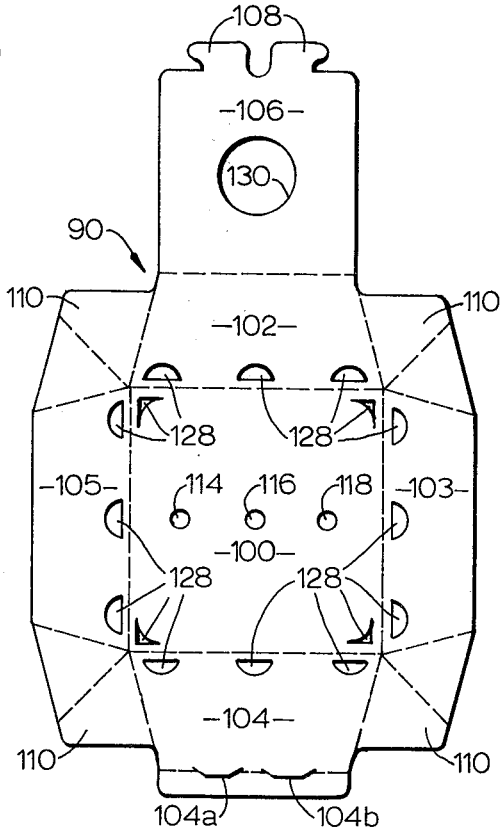
FIG. 21

FOOD HEATING CONTAINER

This is a continuation-in-part of an application bearing the same title, filed July 13, 1981, Ser. No. 283,145, which is a continuation of Ser. No. 33,972, filed Apr. 27, 1979, now abandoned.

FIELD OF THE INVENTION

This invention relates to the packaging of food products that are to be heated in a microwave oven.

THE PRIOR ART

The vast increase in demand for microwave heating ovens particularly those used by the consumer has resulted in a need for packaged food products that can be heated in these ovens quickly, efficiently, and uniformly. The results have, however, often been disappointing. Two of the most common problems are the unevenness of heating and the presence of dry spots in some areas where the food has been overheated together with cool or icy spots in other parts of the package. This unevenness in temperature is largely the result of what is sometimes referred to as run-away heating, a term used to designate heating in localized areas that often continues until it reduces or destroys the palatability of the food product. The problem is particularly troublesome with frozen food products because ice crystals themselves are relatively transparent to microwave energy. Hence, they do not absorb the energy at the rate water absorbs energy.

Thus, the liquid portion of food product held in an ordinary dish or bowl will heat at a very rapid rate, but frozen portions take up heat slowly and tend to remain frozen. When a package is subject to runaway heating, temperatures rise faster in the outer portions of the package. For example, in tests have been run in the development of the present invention it was found that one frozen food reached 180° F. on the outside surface but was at about 0° F. near center. Performance of this kind is entirely unacceptable.

It has been suggested in recipe books to pile up food, for example potatoes, in a circle around the edge of the plate to provide more uniform heating. This helps but requires manual attention and is not suited for fluid or liquid foods.

Many attempts have been made to improve microwave heating. For example, U.S. Pat. No. 3,985,990 describes a baking utensil having a microwave transparent top and compartmented metallic container with a central divider separating two different food substances shown in FIG. 2 of patent. The entire container is held in a paper pie plate. No provision is made, however, for improving the uniformity of heating within each of the two food bodies.

U.S. Pat. Nos. 2,600,566 and 2,714,070 in FIGS. 2 and 7, respectively, describe packages for two different food substances such as ice cream on the outside and ice cream topping on the inside. The topping in each case is contained in an edible dish within the ice cream. The ice cream itself is held within a metal shield. During heating, the ice cream remains frozen while the topping is heated at a much faster rate. An important result accomplished by each patent is to keep a food product from being heated above the freezing point. By contrast, the present invention will increase heat absorption.

U.S. Pat. No. 3,965,323 describes a method and apparatus for heating and browning foods in a microwave oven through the use of a shallow ceramic dish having a peripheral U-shaped channel. A surface coating is applied to the bottom of the central portion of the dish. This coating becomes extremely hot; hot enough to brown or sear the bottom of the food product. Because of its heavy weight, the dish is not suitable for shipping and serving foods. Its primary utility is in browning the surface of a food product such as steak.

U.S. No. 3,271,169 discloses a food package for microwave heating comprising a plastic tray having several food containing compartments separated by partitions. The bottom wall of different portions of the tray may have different heights causing the food to heat at different rates. Some of the compartments are provided with a recess around the periphery. The tray has utility in heating a meal containing several foods.

The U.S. Pat. No. 4,031,261 to Durst provides a beverage composition that can be thawed from frozen condition with microwave energy. The beverage is frozen as many separate chunks or with a central hole. One major problem with this approach is that during heating, the melted beverage quickly fills up the spaces or openings. In this way the entry of microwave energy through any opening or passage that was initially present is interrupted. Accordingly, the advantage of an opening is lost after the initial heating period melts a portion of the food.

It is also known to provide compartmented or non-compartmented containers with partial microwave shielding e.g. aluminum foil as described for example in U.S. Pat. Nos. 3,219,460 and 3,547,661. These patents show the principle of selective microwave admission through a slotted shield. However, there is nothing present to facilitate entry of the microwave energy into the food itself.

The general objective of the invention is to overcome these and other deficiencies of the prior art. These and other more detailed and specific objects of the invention will be apparent from the accompanying description and drawings.

THE FIGURES

FIG. 1 is a perspective view of a microwave heating container as seen during heating within a microwave oven.

FIG. 2 is a perspective view of a heating container on a larger scale partially broken away for clarity of illustration with the top elevated so that the interior can be seen.

FIG. 3 is a vertical sectional view taken on line 3—3 of FIG. 2 with the food entirely frozen.

FIG. 4 is a view similar to FIG. 3 after heating had been started.

FIG. 5 is a view similar to FIGS. 3 and 4 during a later stage of heating.

Figure 8:
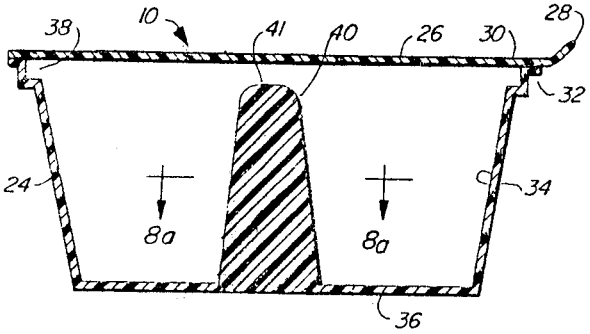
FIG. 8 is a vertical, sectional view of another form of container in accordance with the invention.
Figure 8A:
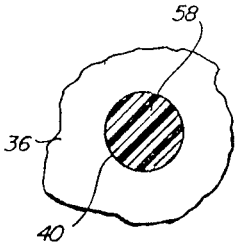

FIG. 8*a* is a horizontal sectional view taken on line 8*a*—8*a* of FIG. 8.

Figure 9:
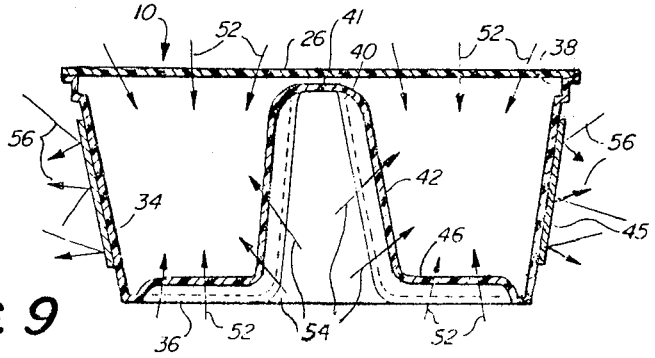

FIG. 9 is a vertical cross-sectional view of the container of FIGS. 1 through 5 showing microwave energy entering and reflected from portions of the container.

Figure 10:
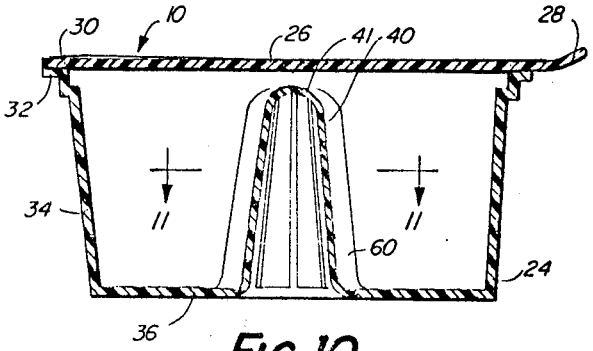

FIG. 10 is a vertical cross-sectional view of another embodiment of the invention.

Figure 11:
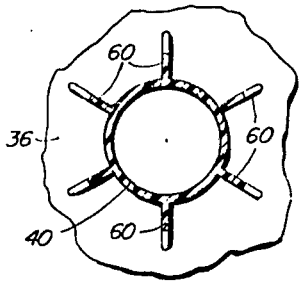

FIG. 11 is a horizontal partial cross-sectional view taken on line 11—11 of FIG. 10.

Figure 12:
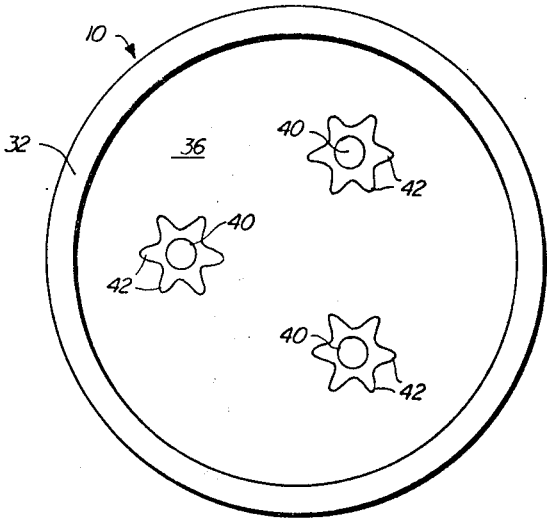

FIG. 12 is a top view of food heating container in accordance with another form of the invention with the top removed.

Figure 13:
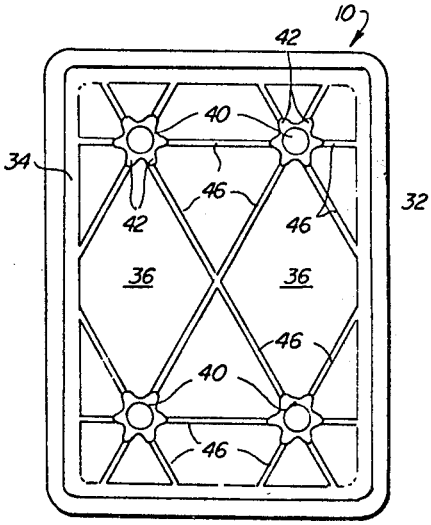

FIG. 13 is a top view of another form of package in accordance with the invention.

Figure 14:
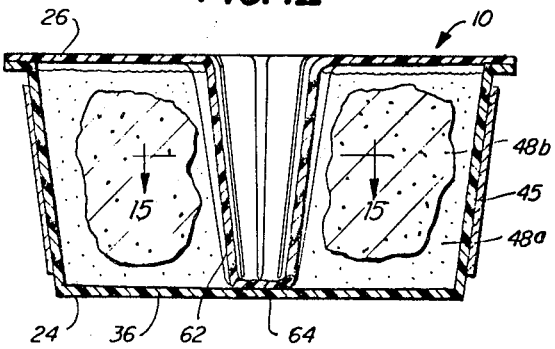

FIG. 14 is a vertical cross-section of still another modified form of the invention.

Figure 15:
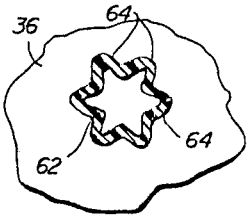

FIG. 15 is a horizontal partial transverse sectional view taken on line 15—15 of FIG. 14 and FIG. 16 is a schematic flow diagram of the process.

FIG. 17 is a perspective view of another embodiment.

FIG. 18 is a cross-sectional view taken on line 18—18 of FIG. 17.

FIG. 19 is a perspective view of the inner food container after removal from the outer enclosure.

FIG. 20 is a bottom perspective view of the partially opened package.

FIG. 21 is a plain view of the carton blank and

FIG. 22 is a partial vertical sectional view of the center of the package as the cover is being punctured.

FIG. 23 is a partial view similar to FIG. 18 of a modified form of the carton.

SUMMARY OF THE INVENTION

The invention concerns a disposable microwave food heating container and a method of preparing food for microwave heating. When filled with food the container may be referred to as a package. The container includes a generally bowl- or dish-shaped bottom portion to hold the food product. The container includes a bottom wall that is preferably transparent to microwave energy and an upwardly extending sidewall defining an opening at its top for filling the container with food and for removing food when the food is to be served. A cover formed from sheet material preferably extends across the top opening of the container and seals the opening. Within the container is a low loss core formed from microwave transparent packaging material. The core extends vertically between the top and the bottom of the container to provide the tubular microwave influx passage through the food in the container.

In the method of preparing food in accordance with the invention when a core is used, a food product is placed within the disposable shipping container. A tubular passage extends through the food surrounding the core. The interior of the core is maintained free from food. The container and food product are then chilled. In most but not all foods chilling stiffens or solidifies the food to predetermined shape such that a tubular passage having the shape of the core extends through the food around each core. The resulting packaged food may be shipped or distributed in commerce. It is then subjected to microwave heating within the package whereby microwave energy will readily pass into the package through the core to accelerate heating of the food and especially that portion near the core throughout the application of microwave energy. The invention, it was discovered, also makes the temperature much more uniform throughout.

Briefly, the process employed in a preferred form of the present invention comprises first providing a food product with dipolar molecules i.e., molecules that will couple with microwave energy. Coupling of the food product with microwave energy heats the food product; and such is the meaning to be attached to the term "coupling." The disposable shipping container already described is then filled with the food product. As the container is filled in a preferred embodiment of the invention each core molds or shapes the food such that a tubular microwave influx passage is present in the food at the location of each core. Chilling is carried out to any desired temperature. If the product is to be distributed at refrigerated temperature, chilling is usually carried out to a temperature of about 40° F. If the food is to be frozen, the temperature is reduced to about 0° F. The filled containers or packages are then distributed with the food still in the package. It is then placed in the microwave oven and heated so that microwave energy enters the food product through the container including the food molding core which defines a microwave influx passage in the food. This heats the portion of the food surrounding the core but does not heat the core itself except for heat transmitted to the core by conduction from the food. The presence of the core in the food will maintain the microwave influx passage intact during the heating period and during the liquefaction of the food surrounding the core.

During the development of the invention it was discovered that while being heated the liquefied portions of the food will actually flow upwardly in the vicinity of the core and this flow of liquefied food helps to distribute heat throughout the package. The core thus can also be thought of as a guide for directing the flow of the heated food. The core is preferably positioned vertically in the package and can project downwardly from the top of package or upwardly from the bottom of the package. In a preferred form of the invention, the core extends into proximity with the wall of the package opposite that from which it is supported, that is to say, to less than about an inch and preferably only a small fraction of an inch from said opposite wall. In one form of the invention the core actually touches the opposite wall of the container.

In a preferred form of the invention, the core is provided with flow guiding ribs that extend longitudinally thereof to guide the flow of liquid longitudinally of the core. The ribs can comprise longitudinal corrugations or other irregularities that extend longitudinally. These ribs can, if desired, be extended radially outward from the bottom of the core along the bottom wall of the container and if such extensions are present they guide the flow of liquefied food centrally toward the bottom of the core.

A cover or closure can conveniently be formed from sheet material and is secured across the top opening of the container in a preferred form of the invention. The cover can comprise either microwave transparent or microwave reflective sheet material such as metal foil.

In another form of the invention a ring of microwave reflective material is provided around the periphery of the container. The ring can comprise a strip of metal such as aluminum foil bonded to the outside surface of the container. Such a strip will prevent penetration of microwave energy through the side of the container and promote its entry from the top and bottom. This selective shielding in a preferred embodiment is characterized in that the amount of energy entering the food is not reduced. That is, the temperature change of the total mass of food is equal to or greater than that of a non-shielded package. The shield merely reduces the temperature differential within the container. This is particularly important in that the shielding provided by the invention, instead of interfering with or slowing down heating, improves the efficiency and speed of microwave heating; the very reason that microwave ovens are used.

According to the present invention, the package including a centrally-cored, dish-like container of food having a cover sealed across its mouth is provided in a carton, e.g. made of paper, which encloses a larger space than that occupied by the container of food. The cover of the container of food has regions which may be easily fork-pierced and the carton has apertures overlying these fork-pierceable regions of the container cover. Accordingly, the food may be warmed from a chilled or frozen state by fork-piercing the container cover through the carton apertures for permitting the escape of steam that will be generated in the food during the heating process, and then placing the package, still in its carton, in the microwave oven. As heating proceeds, steam escapes from the food through the pierced holes in the cover and thence from the carton through the apertures which overlie the pierced holes. For further permitting the escape of steam from the carton, one or more additional vent openings, not aligned with fork-pierceable regions in the container cover are provided through the carton wall. The bottom of the carton, at a site in line with the container core, may be provided with a further opening through which the person who is warming the food may insert a finger for manually testing whether the food seems to be sufficiently heated.

DETAILED DESCRIPTION

The invention will now be described by way of example in connection with FIGS. 1 through 7.

As seen best in FIG. 1, a disposable food package 10 embodying the invention is placed during heating in a microwave oven 12 of any suitable known construction. The microwave oven 12 includes the usually oven housing 14, heating compartment 16 which is closed by a door that is partially broken away in the drawing to show the interior of the heating compartment. Controls 18 regulate the operation of a microwave generator or magnetron 20 that provides microwave energy through a wave guide 22 to the interior of the microwave heating compartment 16. As shown in the figures, a disposable food package 10 is placed in the heating compartment 16.

Refer now to FIGS. 2 through 5. As seen in these figures, the package 10 includes a generally dish-shaped container body 24 formed from microwave transparent material such as molded plastic which after it is filled is sealed by a cover 26 formed from flat stock such as suitable packaging sheet material. The cover is provided with a lifting tab 28 so that it can be easily removed.

As seen best in FIGS. 2 through 5, the container body 24 includes a generally upwardly extending circular sidewall 34 and generally flat bottom wall 36. The container body has a top opening 38 through which the food can be introduced and removed. The cover is sealed by adhesive at its periphery 30 to a circular lip or flange 32 at the upper edge of the sidewall 34. If desired, the cover can in the alternative be snap fitted over the sidewall.

The container body includes a central core 40 which in this instance is disposed vertically. The core 40 is integral with and extends upwardly from the bottom wall 36. It comprises a hollow, thin-walled, upwardly-directed, finger-like projection contoured from the bottom wall 36 that extends into proximity with the top wall 26, that is to say, close to the plane of the lip 32 at the top edge of the sidewall 34. As seen in the figures, the core 40 tapers slightly toward the center proceeding upwardly toward its top end. It is closed at its upper end 41. The core 40 is thus integral with the bottom wall 36 and is composed in this instance of the same material from which the bottom wall is formed. Distributed circumferentially of the core 40 are a plurality of longitudinally and vertically extending generally parallel ribs 42 which in this instance comprise corrugations in the wall of the core.

The ribs 42 also extend peripherally and radially across the bottom wall of the container to define radial rib extensions 46. It can be seen in FIGS. 2 and 3 that rib extensions 46 project upwardly from the bottom wall 36. It is, however, possible to form extensions 46 so that they project downwardly below the surface of the bottom wall 36 instead of extending upwardly as shown. Extending around the sidewall 34 is a microwave reflective ring such as an aluminum foil strip 45.

While six ribs are shown, a larger number of ribs can be used. For example, ten or more ribs may be used in some cases. Thus the precise number of ribs is not considered critical. From about four to ten ribs appear to be optimum on the basis of current tests. Within the food package is provided food product 48 containing dipolar molecules such as water or fat. While a variety of foods can be provided, typical foods include meal entrees, such as chili, baked beans, spanish rice, macaroni and cheese, soups, etc.; vegetable dishes such as creamed asparagus, spinach, corn, peas, carrots, etc., and any of a variety of fruit dishes, beverages or desserts such as custards, puddings, etc.

The food product of FIG. 3 is frozen and is shown as it appears when the package 10 is just withdrawn from the freezer. After a short period of heating as shown in FIG. 4, the periphery of the food product becomes thawed as shown at **48*a*. The frozen portion 48*b* remains as a ring located generally between the core 40 and the sidewall. It will be noticed the food product is liquefied in the area immediately surrounding the core. This illustrates the effectiveness of the core in helping to heat the center portion of the food within the container. It was observed during operation that while the food product is being heated, a portion of the food product surrounding the core flows upwardly in the area immediately adjacent to the core. This flow has been indicated generally at 50 in FIGS. 4 and 5**.

If desired, the cover 26 can be made of microwave energy reflective material such as aluminum foil or foil coated paper in which case it is preferred not to use the shielding ring 45. When the cover 26 is formed from aluminum foil, all of the microwave energy must enter the package from the sides and bottom.

Refer now to FIG. 9 which illustrates the microwave energy depicted by arrows 52 entering the package at the top and bottom. The figure also shows microwave energy entering the package along lines 54 which extend from the core into the food. Microwave energy striking the side of the package (lines 56) will be reflected and enter at 52 or 54 where it will be absorbed. It can be seen in this way that the core 40 forms a microwave influx passage through the food product and that this passage remains intact the entire time the food product is heated.

Refer now to FIGS. 8 and 8*a* which show a modified form of container in accordance with the invention with corresponding parts illustrated by the same numerals used in FIGS. 1 through 7 and 9.

The container 10 in FIGS. 8 and 8*a* is the same as that already described except for the core 40 which in this case comprises a non-loss or low loss microwave transparent body which is homogeneous throughout. The core in this instance can be solid plastic, foamed plastic, molded paper, etc., or a combination of them. One preferred core material comprises foamed polystyrene. The interior 58 of the core is not hollow in this instance as it was in the previous figures. Its function is however the same. Since the core 40 is transparent to microwave energy, the core forms an influx passage through the center of the food product allowing microwave energy to enter through the core and pass readily into the food surrounding the core. During heating, the core remains intact as before thereby holding the microwave influx passage in place within the liquefied food product. This allows microwave energy to enter through the core during the entire heating period.

The embodiment of FIGS. 8 and 8*a* is particularly advantageous when it is desired to use an ordinary flat bottomed dish without a central core. In such a case, the core 40 of FIGS. 8 and 8*a* is a separate piece of material which can be bonded to the center of a flat bottom wall 36 during fabrication. It will be noted that the core 40 in this instance has a smooth exterior surface and is without ribs. However, as described above in connection with the prior figures, the addition of ribs will provide greatly improved performance for most foods. Satisfactory performance can be obtained for some foods without using ribs.

Refer now to FIGS. 10 and 11 wherein the same numerals refer to corresponding parts already described. The disposable food package 10 is in all respects similar to that described in FIGS. 1–7 and FIG. 9 except for the core 40 which in this instance is provided with a different type of rib. The ribs in this case comprise a plurality of longitudinally extending, circumferentially spaced flanges 60. It will be seen that the flanges are integral with the core 40 and project radially outward therefrom. The flanges 60 function generally similar to the ribs already described to provide channels therebetween which function to guide the flow of liquefied food upwardly along the outer surface of core 40. This helps to distribute the heat during the heating operation thereby increasing the uniformity of temperature within the heated food product.

Referring now to FIG. 12 which illustrates a modified form of package, the disposable food package 10 in this case is provided with a bottom wall 36 having three upwardly projecting cores 40 each of which is provided with six longitudinally extending circumferentially spaced ribs 42. This embodiment is preferred for containers of larger sizes in which additional interior heating is desired. Thus during operation the microwave energy will enter the food through the microwave transparent cores 40 at three different locations for the food contained in the package.

Refer now to FIG. 13 which illustrates a further modified form of the invention. The package is similar to those already described with the following changes. The outline of the sidewall package is rectangular rather than circular and the flange 32 at the top of the sidewall 34 is also rectangular. In addition, the container 10 is provided with four spaced-apart, vertically-extending cores 40 each with a plurality of longitudinally extending ribs 42 which are coextensive at their lower ends with radial rib extensions 46 which radiate outwardly from the base of each core 40. Some of the rib extensions are connected together at their ends. as seen from above, the connected ribs 46 form a latticework between the cores 40. Each converging set of radial rib extensions surrounding each core 40 helps to guide the liquefied food toward the base of each core.

Refer now to FIGS. 14 and 15 which show another modified form of the invention. The disposable food package 10 is generally similar to that described above except for the core 62. The core 62 in this case is integral with and supported by the cover 26. Thus the core comprises a hollow, finger-like projection extending downwardly from the plane of the cover 26 into proximity with the bottom wall 36. Since the core 62 is in part of the cover, the container 24 has a flat bottom 36 which is uninterrupted. As a result, food can be spooned from the container more easily than in the prior embodiments. It will be seen that the free unsupported end 64 of the core 62 extends into proximity with the bottom wall 36. In this instance it actually contacts the bottom wall 36. The core 62 is provided as can be seen with the plurality of radially projecting longitudinally extending ribs or corrugations 64 within the wall of the core 62. These ribs serve as before to help direct the flow of melted liquefied food product longitudinally of the core thus distributing the heat around the surface of the frozen portion 48*a*.

The process used for preparing foods in accordance with the invention will now be described in connection with FIG. 16.

A disposable shipping container of a suitable size is provided. If a single serving container is to be used, it may contain about 5–10 ounces of food. In this instance the container would have a height of about 1.75 inches and a diameter of about 3.9 inches at the top. The heating core is transparent to microwave energy as already described. The container is filled with the food product. It should be noted that the interior of the core is maintained free from food. Usually the container is filled almost to the top with a portion of the core projecting out through the top of the food. However, food can entirely cover the top of the core if desired.

The core usually but not necessarily functions to mold or shape a tubular microwave influx passage within the food and it is through this passage that the microwave energy enters the food throughout heating. The core also provides a thermal directing mechanism for liquid.

Next, the container with the food in it is chilled. If cooled to a low enough temperature the food is solidified to a predetermined shape. The predetermined shape may not be an absolutely permanent one, for example, if the food has a sticky or pasty consistency and is not completely solid. However, if the food is frozen, the predetermined shape will be quite permanent. In this way a tubular passage in contact with the outer surface of each core extends through the chilled food. The food is distributed through channels of commerce within the container so that during subsequent microwave heating, microwave energy will readily pass in through the core and heat the food around each core. Heating is carried out as described above by placing the filled container within the microwave oven 12.

During operation, the bubbling and upward flow of heated liquefied food at 50 facilitates the movement of hot liquid material to the cooler regions of the package thereby distributing heat more uniformly throughout the package. The core 40 thus functions both as an influx or inlet passage for microwave energy and also as a means for directing or guiding the flow of fluid vertically at the center of the package.

Figure 6:
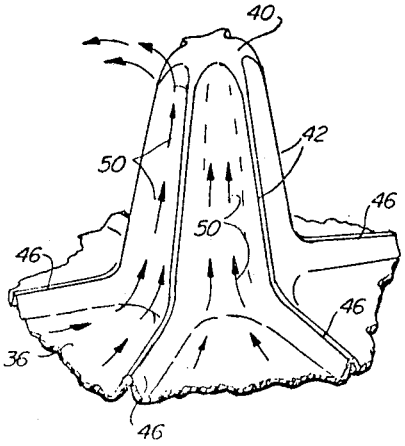
FIG. 6 is a partial perspective view showing the central core portion of the package of FIGS. 1 through 5.
Figure 7:
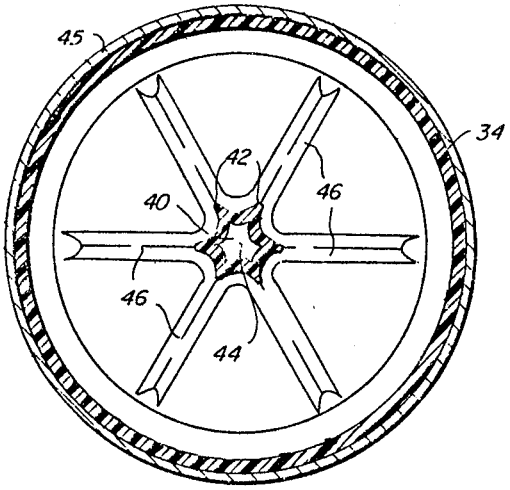
FIG. 7 is a horizontal cross-sectional view on line 7—7 of FIG. 5.

In a typical application of the invention, a serving of 7 ounces of chili with beans was heated from 40° F. in a 1000 watt oven to serving temperature (about 140° F.) in 60 seconds. The same product was heated in a 650 watt oven while frozen at 10° F. to serving temperature in three minutes. The upward flow of liquefied food at 50 is best seen in FIG. 6 between the ribs 42. This flow helps to distribute the heat more uniformly throughout the food body as it becomes warmed within the microwave oven. It will be noticed that the flow lines are vertical and generally parallel to the longitudinal axis of the core 40. It will also be seen that the radial rib extensions 46 help to guide the hot liquid portion of the food product at the bottom toward the center of the core 40. In addition, they help to strengthen the package. Their primary function, however, is to guide the flow of liquefied foods centrally toward the core 40. It has been noticed that packages containing the radial rib extensions 46 are heated more uniformly after a given period of heating than similar packages that do not contain such ribs. The ribs 42 and 46 also add structural strength at elevated temperatures. It was discovered that the packages of the invention have a lower surface temperature. It is believed that the added surface area provided by the ribs 42 and 46 enables the container to radiate heat more rapidly and thereby helps to prevent overheating at the surface. For this reason plastics and other materials of marginal operating characteristics have better strength after heating.

It was noted in preliminary studies during the development of invention that changes in core and rib size can produce some differences in heating rate and uniformity. However, the optimum size core and rib for one food will not necessarily be optimum for another. It was found, for example, that in heating various main dishes, etc., that outstanding results could be obtained with a core having a height of 1.7 inches, a diameter at the bottom of about 1 inch, a diameter at the top of about 0.3 inch with six ribs, each having a height as seen in cross-section of about 0.2 inch. Thus, the core height in this case is about two times the diameter of the core at the base. It was also discovered during these tests that three large ribs each about $\frac{1}{4}$ inch square would not produce the uniformity and speed of internal heating that was found with ribs as shown in the figures although some improvement was obtained.

Concerning core shape, it is preferred that the core comprise an elongated finger-shaped projection. The preferred height of the core for chili and for macaroni is about $1\frac{1}{2}$ to about $2\frac{1}{2}$ times the diameter of the core at its bottom or base. It was also found that simply making the core larger does not necessarily improve its performance for a particular food. The dimensions of the core necessary to obtain absolutely the best performance will vary with the kind and amount of food.

In one experiment a cylindrical central core was tried having the same diameter throughout its height with three large ribs of square cross section 120 degrees apart. The diameter of the core not counting the ribs was 0.6 inch. This configuration did not perform as well for heating chili as that illustrated.

As a result of tests thus far conducted it was found that the ribs 42 and 46 appear to be less important for performance when the food is not frozen. Satisfactory performance requires that different portions of the food vary no more than about 22° F. in temperature.

Without ribs 40, the flow of the hot liquefied food is not as straight along the axis of the core 40. Thus the ribs 42 appear to serve as a guide means for directing the flow of liquefied food longitudinally along the core thereby distributing heat more rapidly.

It was found that the best results are obtained when the bottom wall 36 of the container is flat and positioned approximately parallel to the top cover 26. For example, in one test the bottom wall was made conical i.e. elevated slightly near its center. This configuration was found to provide significantly less benefit than the flat bottom dish illustrated. For some foods, the bottom wall 36 can be slightly inclined upwardly proceeding toward the core to achieve improved heating.

The container can be formed by any of a variety of microwave transparent materials. The most preferred is paper or plastic or a combination of them. Even molded paper pulp can be used if it has the required moisture and oil resistance. The best results have been obtained with thin walled plastic sheet such as polysulfone, polyesters, polyethylene, polystyrene, polypropylene or other polyolefins and polymethylmathacrylate.

The shielding ring 45 when present is preferably formed from light-weight sheet material such as aluminum foil. It can however, be formed from a variety of different substances such as aluminum paint having the requisite metal content, patches of metal film or even a rigid metal ring applied to the container just before the container is placed in the oven. In this instance, the metal ring would not have to be a part of the package. It could, for example, comprise part of a metal tray or ring with the bottom cut out into which the package is placed during heating. Such a rigid metal ring could also comprise a part of the oven in some instances. This variation might be desirable where large numbers of meals are being heated e.g. in an aircraft or ship. However, in the preferred form of the invention, the shielding ring 45 comprises a circular sheet of aluminum foil bonded to the container, extending entirely around the sidewall 34 of the container and having its bottom edge located approximately a quarter of an inch above the bottom 36 of the container.

The shielding ring 45 is particularly beneficial when the food product is frozen. In this instance the shield cooperates with the core 40 to produce extremely good results when compared with a dish containing either the core alone or the shield alone. An important benefit of the shielding ring 45 is the relatively low temperature of the outside of the package following heating. This enables it to be removed from the oven by hand without burning the fingers. This important advantage was noted by a number of test subjects who used the invention.

The invention will be better understood by reference to the following examples.

A series of comparative tests were run in each case by heating 7 ounces of frozen chili at 0° F. for 3 minutes in a 650 watt home microwave oven with 8 temperature probes per sample to sense the temperature both near the outside and near the center of the package. The results were as follows:

TABLE I

| Example | Description of Package | Average Temperature Difference Between Inside and Outside | Mean Temperature The Food Mass |
|---|---|---|---|
| | FROZEN FOOD | | |
| 1 | The invention as exemplified by FIGS. 1-7 | 22° F. | 151.2° F. |
| 2 | Like Example 1 but with no shield 45 | 39° F. | 148.6° F. |
| 3 | Container FIGS. 1-7 with shield 45 but no core 40 | 48° F. | 115.9° F. |
| 4 | Container with non-ribbed core (FIGS. 8-8a and no shield) | 88° F. | 126.9° F. |
| | COMPARATIVE EXAMPLE | | |
| 5 | Ordinary flat bottomed dish with no core or shield | 115° F. | 118.9° F. |

By reference to Examples 1-5, it will be seen that a core alone (Example 4) reduces the temperature difference by 27° F. and increases the mean temperature by about 8° F. The use of a ribbed core and shield (Example 1) reduces temperature differences by 93° F. and surprisingly increases the overall heat absorbed, the mean temperature being 32° F. warmer than Example 5. This demonstrates the surprising ability of the invention to cause the food to reach a higher mean temperature after the same heating conditions in a microwave oven. While the reason for these improvements is not known with certainty, it is hypothesized that less heat is wasted in boiling away steam. Comparing especially the last column of Table I with, for example, the above noted U.S. Pat. Nos. 2,600,566 and 2,714,070 it will be seen that while the patents retard heating, the invention does just the opposite; it enhances heating. Moreover, the shield functions, when used, to achieve more even heating instead of producing temperature differences.

A second set of runs were conducted in each case by heating 7 ounces of chili at 40° F. for 60 seconds in a 1000 watt oven. Again 8 temperature sensing probes were used in each sample to record the temperature both around the periphery and near the center. The average temperature differences between the inside and outside were as follows:

TABLE 2

| Example | Description Of Package | Average Temperature Difference |
|---|---|---|
| | REFRIGERATED FOOD | |
| 6 | The invention as exemplified by FIGS. 1-7 | 6° F. |
| 7 | Like Example 6 but with no shield 45 | 27° F. |
| 8 | Container with non-ribbed core (FIGS. 8-8a ad no shield) | 53° F. |
| | COMPARATIVE EXAMPLE | |
| 9 | Ordinary flat bottom plastic dish with no core or shield | 69° F. |

By reference to Examples 6-9 it will be seen that the non-ribbed core (Example 8) produces a temperature difference of 16° F. less than an ordinary plastic dish (Example 9) and in the case of Example 6 the temperature difference between the center and the outside is 63° F. less than Example 9. Moreover, improvements were achieved even though the food was in a liquid condition before heating was started.

The reference to a low-loss core herein is reference to a core whose wall is substantially transmissive to microwave energy and causes little loss or absorption of the energy on its way to the food in the container.

The performance of the invention as described thus far is generally excellent but has some shortcomings particularly for certain applications and when used with particular foods. For example, in the case of foods that contain high amounts of water or fat, the package 10 can burn the fingers when heating is completed. Occasionally one may begin to remove the product from the oven and suddenly drop it because the fingers have been burned. In some cases the container may also cool off too quickly. Another problem is that of inadequate display space for labels, instructions, use information, ingredient listing, nutrition information, etc. Still another problem is the occasional popping open of a sealed container during heating. This can splatter the food around the oven which is of course objectionable to the user. In addition, the temperature of the food is difficult to ascertain.

To overcome these problems and others, the package of FIGS. 17-23 was developed. Briefly, this package comprises a sealed inner disposable food container comprising a bottom dish body having bottom wall and a side wall terminating in an upper free edge defining an open mouth for filling the dish and for removing the food. A quantity of food is contained in the dish and a cover defining a top wall is sealed across the top of the dish to enclose the food. A vertically disposed finger shaped core preferably extends between the top and bottom walls and is supported from one of them to define a vertical microwave influx passage. In some cases, the core is unnecessary and can be eliminated e.g. where it is desirable for a center such as ice cream to remain cold or in the case of certain foods such as potato salad as well as foods that are not frozen before heating. The sealed container is enclosed in an insulating outer enclosure formed from paper or plastic. This enclosure is also disposable and preferably has three sets of openings comprising a probe insertion opening adjacent the cover for piercing the cover, steam vent openings adjacent the top of the carbon to allow steam to escape easily toward the side as well as in an upward direction and an access port in the bottom to provide access to the interior of the core (when the core is supported on the bottom wall). The core can be touched lightly through this opening to determine if the food has been heated enough. This embodiment of the invention will now be described in detail.

Turn now to FIGS. 17-22 wherein the same numerals refer to equivalent parts already described. As shown in FIGS. 17, 18, and 20, the package 10 includes an open-mouthed container body or dish 24 having a side wall 34 of circular shape extending upwardly from a bottom wall 36 and terminating in an upper wide mouth or top opening 38 through which the dish is filled. It will be noted that the side wall 24 is smooth, i.e. internally unribbed. The core 40 is finger shaped and is composed in this case of an upwardly deflected center portion of the bottom wall 36 with vertically disposed parallel ribs 42 spaced apart circumferentially around the core with radial extensions 46 in bottom wall 36. A piercable cover 26 is sealed to a circular horizontal lip 32 at the top of sidewall 34.

The package 10 thus far disclosed is formed from microwave transparent material as described above and is filled, sealed and processed the same as described in connection with FIGS. 1–16. The package 10 is however enclosed within an insulating outer enclosure 90 formed from paper, plastic or other microwave transparent material. The insulating enclosure can for example, comprise paperboard or light-weight polystyrene plastic sheet. As may seen in FIG. 21, which illustrates the die cut blank from which the enclosure is formed, there are six main panels, including a relatively large size rectangular top panel 100, four side panels 102–105 hinged thereto and a bottom panel 106 hinged to the opposite edge of panel 102 from panel 100.

Panel 104 is provided with locking slots 104*a* and 104*b* to receive connecting tabs 108 that extend from the free edge of panel 106. Between the side panels are corner fold webs 110. These webs or corner folds are folded centrally as the side panels are lifted to set up the carton. The package 10 is then inserted and the tabs 108 are inserted into the locking slots 104*a* and 104*b*. It will be noted that the side panels are larger adjacent panel 100 i.e. trapazoidal so that the bottom 106 is smaller, thereby just fitting around the smaller bottom wall of package 10. Typically, enclosure 90 is a multi-panel folding paper or plastic carton.

The insulating enclosure 90 has three separate sets of openings. The first are cover-piercing apertures 114, 116, and 118 in top panel 106 through which a sharp object such as a fork, pencil or other object 120 (FIG. 22) is thrust to pierce the cover 26 thereby forming steam vents 124, 126 and 127 which with the enclosure 90 prevent the package 10 from popping open and splattering food about the oven. The steam that accumulates in the enclosure 90 then escapes through a second set of vent openings 128 located generally in the top of the side panels and near the edge of the top panel 100. These vents prevent steam from accumulating inside the enclosure 90 and causing possible burns to the fingers since it was learned that while most steam will escape through openings 124–127, some may escape at other points or for other reasons remain within the outer enclosure 90. As can be seen in FIGS. 17, 18, and 20, an air space is present between the package 10 and enclosure 90. This assists in insulating the fingers from package 10. The tucked in corner folds 110 help to suspend and cushion the package 10.

A third opening 130 is provided in the center of bottom panel 106. Opening 130 provides an access port through which it was discovered the temperature of the food after heating can be accurately determined.

After the package 10 has been filled and sealed as described above, it is placed in the enclosure 10 and the tabs 108 inserted into locking slots 104*a* and 104*b*. The package is then chilled or frozen and shipped to the user. The user punctures the opening 122, 124 and 126 through apertures 114, 116 and 118 and places the package 10 while still in the enclosure 90 within the microwave oven. The user may remove the package periodically without burning himself and it was found that by inserting a finger through access port 130 into the core 40, that the overall temperature of the food can be accurately ascertained. When steam is evolved, most will escape through vents 124, 126, and 127. There are insulating air spaces between package 10 and enclosure 90. These spaces will stay free of steam since it can easily escape through steam vent openings 128. When heating is complete, the enclosure is removed and the food eaten from the dish 24 after removing the cover 26 by pulling up on tab 28. As in the previous embodiments described in FIGS. 1–16, the core 40 and its ribs 42 assist in heating at the center and in facilitating the fluid conviction of hot liquid while the unribbed side wall 24 does nothing to promote heating at the periphery. In this way, heating is balanced between the interior and exterior of the package. At the same time the enclosure 90 which is spaced at points from package 10 provides an insulating function while the apertures 114–118 facilitate the puncturing of steam vents thereby preventing blow-ups and the splattering of food. During heating the package can be removed and the food temperature easily found by touching the core through access port 130.

When used, the microwave-opaque, reflective shield 45 may have other configurations if desired. For example in FIG. 17 is shown a modified shield 45*a* which comprises a loose, self-supporting, cylindrical ring of aluminum foil preferably with a paper backing for added strength. This ring 45*a* encircles the dish body 24 and has the same height as the dish body, but is not connected to it physically. Assembly of the package is simplified; the dish 24 is simply dropped into ring 45*a* and both are then placed in the insulating outer enclosure 90. The ring does not have to be bonded to the container.

FIG. 23 shows a modified package with no core 40. Instead, the bottom wall 36 is flat and undeflected at the center. This embodiment can be used whenever heating within the food is not needed. A microwave reflective shield 45 can be provided and was found surprisingly effective in maintaining a uniform temperature throughout the package.

What is claimed is:

1. A package of cold food heatable in a conventional microwave oven directly from a refrigerated or frozen condition with an improved steam-venting capability and improved uniformity of temperature, said package of food comprising:

a sealed package including a disposable container comprising two main wall members, including one wall member comprising a cover formed from sheet material and another wall member comprising a dish body having a bottom wall and an internally rib-free, upwardly-directed peripheral sidewall at the outer periphery of said bottom wall with an upper edge defining an upwardly-open wide mouth;

said cover being secured to said sidewall so as to close said mouth and provide a sealed cavity within said container;

said dish body bottom wall having a centrally-disposed, upwardly-extending, upwardly-tapering hollow core positioned thereon and projecting vertically within said container;

said core comprising a finger-shaped member extending betwen said bottom wall and said cover and having a closed upper end positioned in proximity to said cover;

said core including surface means thereon within said sealed cavity providing a perimetrically-extending wall having a plurality of angularly-neighboring ribs extending longitudinally therealong;

said core being perimetrically surrounded by a body of cold food;

said body of cold food in said sealed cavity containing water in liquid or frozen form, being in the range of about 40° F. and about 0° F. when said package is in said refrigerated or frozen condition, filling said sealed cavity at least to a substantial depth within which said food is disposed for contact with said ribs of said core and with said rib-free sidewall, and existing as a unitary entity without partitionment into a multiplicity of unconnected entities;

said core wall and cover being substantially transmissive of microwave oven microwave energy for functioning in use as a microwave influx passage for entry of microwave energy into said food within said container;

said core including said ribs thereof being structured and arranged for functioning during microwave heating of said food as a guide means for directing the flow of fluid portions of said food in an upward direction in the vicinity of said core, whereby said core including said ribs thereof contributes to the distribution of heat in said container during microwave heating of said food in said container in a microwave oven by assisting in fluid convection and the absence of ribs on said sidewall within said cavity cooperates with the presence of said ribs on said core to balance microwave heating of said food throughout said cavity and provide more uniform heating of said food than would a similar package having ribs provided on its peripheral sidewall within its cavity;

said package further including a carton having wall panel means providing an enclosed space having a larger volume than that occupied by the food-containing covered dish;

the food-containing covered dish being disposed within said carton, both for while said food is in said refrigerated or frozen condition and for microwave oven heating of the food;

said carton wall panel means including a top wall panel disposed in overlying proximity to said cover and having at least one aperture therethrough designated to provide a steam vent;

said cover, at least in a respective region directly in vertical alignment with each such designated steam vent aperture being constituted of easily fork-pierced material so that just prior to placing the entire package of cold food in a microwave oven for heating, the consumer may pierce a hole through each such region of the cover by inserting a sharp object such as a fork tine through the respective designated steam vent aperture;

said carton wall panel means further including at least one steam vent opening from said enclosed space, this at least one steam vent opening not being associated in direct vertical alignment with any said easily fork-pierced region of the cover, and this at least one steam vent opening being constructed and arranged to permit the escape of steam from said enclosed space.

2. The package of claim 1 wherein the steam vent holes in the insulating enclosure comprise vent holes in the top panel of the enclosure.

3. The package of claim 1 wherein the carton has an access port in its bottom panel to enable the temperature of the food in the container to be ascertained through the sense of touch.

4. The package of claim 1 wherein the insulating enclosure contains steam vents in the top panel thereof to exhaust steam from the air spaces and an access port in the bottom panel to enable the temperature of the food in the container to be ascertained through the sense of touch.

5. The package of claim 4 wherein the port in the bottom panel of the enclosure is aligned with the core so that a user may extend a finger through the port and into the core to determine the temperature of the food through the sense of touch.

6. The package of claim 1 wherein the enclosure is a folding carton with top, bottom and side panels and the bottom panel has an access port therein in alignment with the core.

7. The package of claim 1 wherein a layer of microwave opague material at least partially encircles the sidewall of the container to balance microwave heating between the interior and periphery of the food in the container.

8. The package of claim 7 wherein the layer is a ring of aluminum foil bonded to the sidewall of the container.

9. The package of claim 7 wherein the layer is a self-supporting ring of aluminum foil loosely fitted around and encircling the sidewall of the container.

* * * * *